United States Patent [19]

Ishikawa

[11] Patent Number: 4,838,715

[45] Date of Patent: Jun. 13, 1989

[54] INK RIBBON CASSETTE

[75] Inventor: Hiromichi Ishikawa, Kanagawa, Japan

[73] Assignee: Pilot Man-Nen Hitsu Kabushiki Kaisha, Japan

[21] Appl. No.: 160,043

[22] Filed: Feb. 24, 1988

[30] Foreign Application Priority Data

Feb. 24, 1987 [JP] Japan ..... 62-26104[U]
Feb. 24, 1987 [JP] Japan ..... 62-26105[U]

[51] Int. Cl.[4] ..... B41J 32/02; B41J 31/16

[52] U.S. Cl. ..... 400/196.1; 400/202.4; 400/208

[58] Field of Search ..... 400/194, 195, 196, 196.1, 400/197, 198, 199, 200, 201, 202, 202.1, 202.2, 202.3, 202.4, 207, 208, 208.1

[56] References Cited

U.S. PATENT DOCUMENTS 3,951,253 4/1976 Tibay et al. ..... 400/201 X
4,616,942 10/1986 Nagasawa et al. ..... 400/195 X

FOREIGN PATENT DOCUMENTS 2145974 4/1985 United Kingdom ..... 400/196

*Primary Examiner*—Charles Pearson
*Attorney, Agent, or Firm*—Sughrue, Mion, Zinn, Macpeak & Seas

[57] ABSTRACT

An ink ribbon cassette for supplying ink from an ink-impregnated material to an ink ribbon in which the ink-impregnated material is loaded directly in the cassette body without an ink tank, and in which leakage of ink caused, for instance, by vibration or sudden temperature change, is positively prevented. The ribbon cassette includes a cassette body having a container formed as an integral part thereof and a cover fixedly secured to the cassette body. The container accommodating the ink-impregnated material is formed in such a manner that a space is formed between the ink-impregnated material and the cover, and an ink pool having a capillary action is formed on the inner surface of an outer peripheral wall defining the container.

5 Claims, 2 Drawing Sheets

INK RIBBON CASSETTE

BACKGROUND OF THE INVENTION

The present invention relates to ink ribbon cassettes used, for instance, in printers. More particularly, the invention relates to an ink ribbon cassette in which ink is supplied from an ink-impregnated material to an ink ribbon.

Heretofore, in most ink ribbon cassettes of the type in which ink is supplied to ink a ribbon, an ink tank containing an ink-impregnated material is connected to a locking device provided in the cassette body. However, these cassettes are disadvantageous in that it is necessary to manufacture the ink tank separately, and the cassette body is intricate in construction, with the result that these components are relatively high in manufacturing cost.

An ink ribbon cassette in which an ink-impregnated material is loaded directly in a container integral with the cassette body has also been known in the art. However, such an arrangement disadvantageous in that it is difficult to completely seal the container. Therefore, if the cassette is subjected to vibration or temperature change, the ink has a tendency to ooze through the gap between the cassette body and the cover by capillary action, thus smudging the cassette and other members.

SUMMARY OF THE INVENTION

An object of the present invention is to eliminate the above-described difficulties accompanying a conventional ink ribbon cassette. More specifically, an object of the invention is to provide an ink ribbon cassette in which an ink-impregnated material is loaded directly in the cassette body without an ink tank, and in which leakage of ink caused, for instance, by vibration is substantially eliminated.

The foregoing and other objects of the invention have been achieved by the provision of an ink ribbon cassette for supplying ink from an ink-impregnated material to an ink ribbon, which, according to the invention, comprises a cassette body having a container formed as a part thereof; and a cover fixedly secured to the cassette body, the container accommodating the inkimpregnated material in such a manner that a space is formed between the ink-impregnated material and the cover, and having an ink pool subject to capillary action formed in the inner surface of an outer peripheral wall of the container.

Specific features of the invention reside in the ink-impregnated material loaded directly in the container with the space between the ink-impregnated material and the cover, and the ink pool subject to capillary action formed in the inner surface of the outer peripheral wall of the container.

With the inventive arrangement, even if the ink ribbon cassette is subjected to vibration or abrupt temperature change, the leakage of ink by capillary action is prevented because the ink-impregnated material is not in contact with the abutment of the cover and the outer peripheral wall of the container which receives the ink-impregnated material. Furthermore, even if a small amount of ink does ooze from the ink-impregnated material along the inner surface of the outer peripheral wall towards the cover, the ink is collected and held in the ink pool so that it cannot reach the abutment of the cover and the outer peripheral wall of the container. Thus, leakage of ink is positively prevented.

DESCRIPTION OF THE PREFERRED EMBODIMENTS

Figure 3:
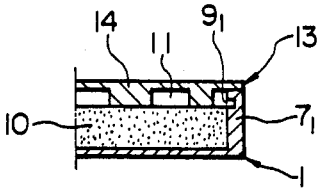
FIGS. 3, 4 and 5 are sectional views showing modifications of a groove-shaped ink pool in the embodiment shown in FIG. 1.
Figure 4:
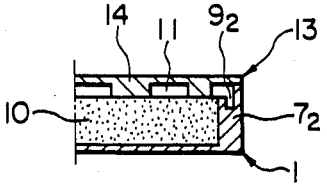
Figure 5:
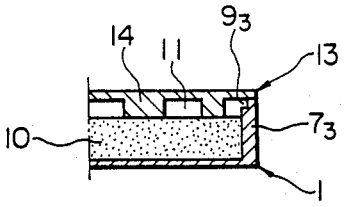

In a first example of the ink pool in the ink ribbon cassette, an inner peripheral wall is formed inside the outer peripheral wall (FIGS. 1 and 2, and FIGS. 6 and 7), and a groove defined by the spaced walls forms the ink pool. That is, the first example is of a double-wall structure. In another example of the ink pool, an annular groove is formed in the inner surface of the upper portion of the outer peripheral wall in such a manner that it opens inwardly or upwardly (FIGS. 3 or 4). In still another example of the ink pool, a step setback is formed along the inner edge of the upper surface of the outer peripheral wall of the container (FIG. 5).

Each of the above-described ink pools is formed along the outer peripheral wall of the container in such a manner that it has an endless and forms the same configuration as said peripheral wall of the containers. However depending on the configuration or size of the cassette body, the ink pool may be formed by a combination of the walls of a double-wall structure and step, or it may be constructed of a plurality of ink pool segments.

In the ink ribbon cassette, at least one linear protrusion is formed on the cover. However, it may be replaced by a plurality of rods.

The preferred embodiments of the invention will now be described in more detail with reference to the accompanying drawings.

Figure 1:
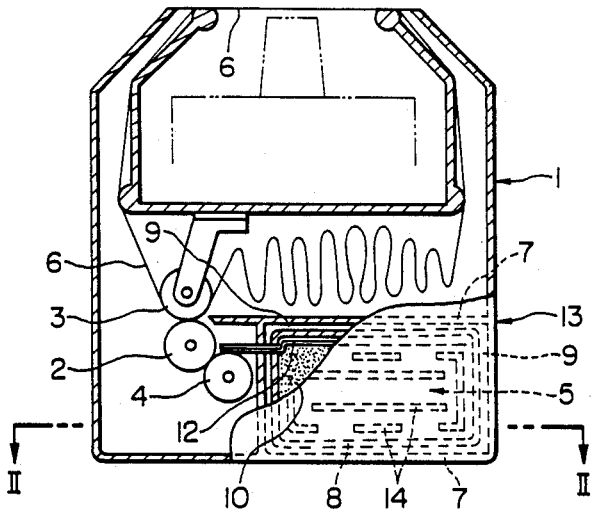
FIG. 1 is a plan view, with parts cut away, showing a first embodiment of an ink ribbon cassette of the invention.
Figure 2:
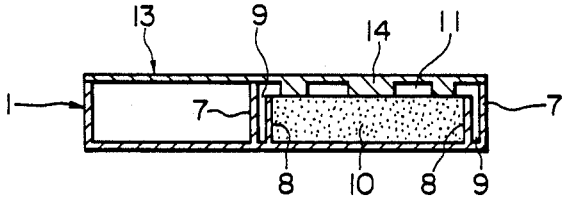
FIG. 2 is a sectional view taken along a line II—II in FIG. 1.

In the first embodiment of the invention, as shown in FIGS. 1 and 2, a cassette body 1 accommodates a pair of ink ribbon forwarding rollers 2 and 3, and an ink transferring roller 4, and includes a container 5 as an integral part thereof. The rollers 2 and 3 are rotatably abutted against each other to forward feed an ink ribbon 6 while holding it therebetween. The roller 4 is rotatably held in contact with the ink ribbon forwarding roller 2.

The container 5 is defined by an outer peripheral wall 7 and an inner peripheral wall 8 provided inside the outer peripheral wall 7. The inner peripheral wall 8 is smaller in height than the outer peripheral wall 7. That is, the container 5 is a double-wall structure. The capillary groove formed between the two walls functions as an peripheral ink pool 9.

An ink-impregnated material 10 is inserted in the container 5 with a space 11 provided above the ink-impregnated material 10. An ink applying member 12 is also inserted in the container 5 in such a manner that it contacts the ink-impregnated material 10 and one end portion thereof protrudes from the container and is held in contact with the ink transferring roller 4 at all times.

A cover 13 is substantially the same in plan view as the cassette body 1. A plurality of linear protrusions 14 are formed on the rear surface of the part of the cover which covers the container 5 when the cover 13 is combined with the cassette body 1 in such a manner that the ends thereof contact the upper surface of the ink-impregnated material 10 to from the aforementioned space 11.

The ink of the ink-impregnated material 10 is supplied to the ink ribbon 6 as follows: As the ink ribbon forwarding rollers 2 and 3 are rotated to convey the ink ribbon 6, the ink transferring roller 4 is also turned, whereupon the ink of the ink-impregnated material 10 is applied to the outer cylindrical wall of the ink transferring roller 4 through the ink applying member 12 and is then transferred through the roller 2 to the ink ribbon.

Even if some ink oozes from the ink-impregnated material 10 due to vibration or an abrupt temperature change as may occur during the storage or transportation of the ink ribbon cassette, the ink is prevented from reaching the abutment of the cover 13 and the outer annular wall 7 because of the space 11 formed between the cover 13 and the ink-impregnated material 10 with the plurality of protrusions 14. Even if a small amount of ink does flow along the outer peripheral wall 7, the ink is held in the ink pool 9 by capillary action; that is, it will not flow towards the cover 13. Thus the ink ribbon cassette is prevented from leaking ink.

In the above-described embodiment, the ink pool 9 is in the form of a deep peripheral, capillary groove defined by two walls. However, the groove defined ink pool 9 may be modified as shown in FIGS. 3, 4 and 5. In the case of FIG. 3, a groove-defined ink pool $9_1$ is formed in the inner surface of the upper portion of the outer peripheral wall $7_1$ in such a manner that it opens inwardly. In the case of FIG. 4, a shallow-capillary-defining ink pool $9_2$ formed in the upper surface of the wall $7_2$ in such a manner that the groove opens upwardly. In the case of FIG. 5, setback capillary groove $9_3$ is formed along the inner edge of the upper surface of the outer peripheral wall 7 facing inwardly towards the interior of the container.

Figure 6:
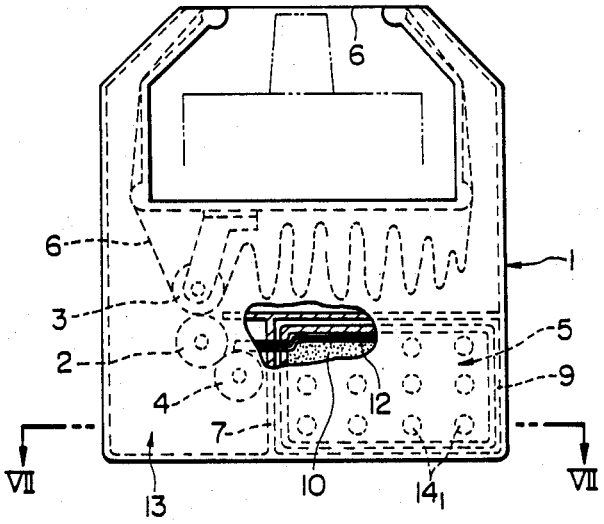
FIG. 6 is a plan view, with parts cut away, showing a second embodiment of the invention.
Figure 7:
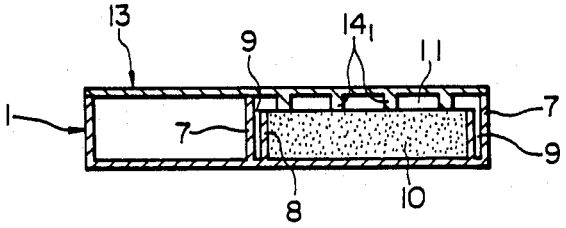
FIG. 7 is a sectional view taken along a line VII—VII in FIG. 6.

FIG. 6 and 7 show a second embodiment of the invention. The second embodiment is similar to the first embodiment except that a plurality of rod-shaped protrusions $14_1$ are formed on the cover 13.

In the ink ribbon cassette of the invention, the space and the ink pool are defined by the outer peripheral wall, the ink-impregnated material and the cover, as described above. Therefore, even an ink ribbon cassette in which the ink-impregnated material is loaded directly in the cassette body can be prevented from leaking ink caused, for instance, by vibration. Thus, the ink ribbon cassette according to the invention is prevented from leaking ink without the need for providing an ink tank or locking device in the cassette body. This greatly contributes to a reduction of manufacturing cost.

What is claimed is:

1. An ink ribbon cassette for supplying ink from an ink-impregnated material to an ink ribbon, comprising:

a cassette body having a container formed as a part thereof, said container being at least partly defined by an outer peripheral wall; and a cover fixedly secured to said cassette body, said container accommodating said ink-impregnated material, at least one of said cover and said body including means forming a space between said ink-impregnated material and said cover, and an ink pool providing capillary action formed in an inner surface of said outer peripheral wall defining said container and being open to said space to hold by capillary action excess ink leaking from said ink-impregnated material.

2. The ink ribbon cassette as claimed in claim 1, in which said ink pool is formed by peripheral groove.

3. The ink ribbon cassette as claimed in claim 1, in which said container comprises inner and outer spaced peripheral walls defining a double-wall structure, and said ink pool is formed by a capillary groove defined by said spaced peripheral walls.

4. The ink ribbon cassette as claimed in claim 1, in which said ink pool is formed by a setback step capillary groove formed in said outer peripheral wall facing inwardly toward the interior of said container.

5. The ink ribbon cassette as claimed in claim 1, in which at least one protrusion is formed in a part of said cover which confronts said container when said cover is combined with said cassette body and having an end thereof contacting said ink-impregnated material.

* * * * *